US008729985B2

(12) United States Patent
Bullock et al.

(10) Patent No.: US 8,729,985 B2
(45) Date of Patent: May 20, 2014

(54) SWITCHGEAR VISIBLE DISCONNECT MECHANICAL INTERLOCK

(75) Inventors: Scott A. Bullock, Bristol, VA (US); Garry F. Raines, Bristol, TN (US)

(73) Assignee: Electro-Mechanical Corporation, Bristol, VA (US)

( * ) Notice: Subject to any disclaimer, the term of this patent is extended or adjusted under 35 U.S.C. 154(b) by 0 days.

(21) Appl. No.: 13/355,848

(22) Filed: Jan. 23, 2012

(65) Prior Publication Data

US 2013/0187733 A1 Jul. 25, 2013

(51) Int. Cl.
*H01H 67/02* (2006.01)

(52) U.S. Cl.
USPC ..... 335/120; 335/119

(58) Field of Classification Search
USPC ..... 335/2, 106, 107, 119, 120
See application file for complete search history.

(56) References Cited

U.S. PATENT DOCUMENTS

| | | | | |
|---|---|---|---|---|
| 2,449,221 | A * | 9/1948 | Hammerly | 335/2 |
| 2,914,707 | A * | 11/1959 | Timmerman | 361/617 |
| 3,161,804 | A * | 12/1964 | Guinan | 361/607 |
| 4,216,521 | A * | 8/1980 | Merola | 361/617 |
| 4,482,936 | A * | 11/1984 | Saito | 361/606 |
| 4,484,046 | A * | 11/1984 | Neuhouser | 218/3 |
| 4,541,033 | A * | 9/1985 | Saito | 361/602 |
| 5,309,317 | A * | 5/1994 | Ishikawa | 361/609 |
| 5,450,281 | A * | 9/1995 | Tanaka et al. | 361/611 |
| 5,767,440 | A * | 6/1998 | Byron et al. | 174/17 VA |
| 5,912,604 | A * | 6/1999 | Harvey et al. | 335/9 |
| 6,225,581 | B1 * | 5/2001 | Gerbert-Gaillard et al. | 200/50.01 |
| 6,285,270 | B1 * | 9/2001 | Lane et al. | 335/6 |
| 7,277,294 | B2 * | 10/2007 | Carlson | 361/727 |
| 8,283,585 | B2 * | 10/2012 | Capelli | 200/50.23 |
| 2005/0139579 | A1 | 6/2005 | Sakamoto et al. | |
| 2013/0187732 | A1 * | 7/2013 | Bullock et al. | 335/6 |

FOREIGN PATENT DOCUMENTS

| | | | |
|---|---|---|---|
| EP | 1548778 | A1 | 6/2005 |
| GB | 2311654 | A | 10/1997 |
| RU | 2020631 | C1 | 9/1994 |
| RU | 2249874 | C2 | 4/2005 |
| WO | 2004/086437 | A1 | 10/2004 |
| WO | 2011020509 | A | 2/2011 |

OTHER PUBLICATIONS

Tavrida Electric "LD Series Circuit Breakers" internet web page http://tavrida-na.com/cb_ld-htm. Retrieved Nov. 31, 2011.

(Continued)

*Primary Examiner* — Bernard Rojas
(74) *Attorney, Agent, or Firm* — The Van Winkle Law Firm; Steven C. Schnedler

(57) ABSTRACT

Electrical switchgear which combines, connected electrically in series, a visible disconnect switch (operated by a main switch actuator) and a circuit breaker module (which may also be termed an interrupter) including circuit breaker contacts which are opened and closed by an electrically-activated magnetic actuator and capable of interrupting fault currents. The magnetic actuator is stable in either a breaker-closed state or a breaker-open state without requiring electrical current flow through the magnetic actuator. An interlock is provided such that, as the main switch actuator begins to move from its switch-closed position to its switch-open position, the breaker-closed state is destabilized to open the circuit breaker contacts. An interlock is also provided such that the circuit breaker contacts cannot close while the visible disconnect switch is open.

12 Claims, 14 Drawing Sheets

(56) References Cited

OTHER PUBLICATIONS

Tavrida Product Brochure downloaded from tavrida-na.com/downloads.htm (2011).

Two-page brochure titled "27kV Vacuum Circuit Breaker" describing one of applicant's prior devices combining a visible disconnect switch and an interrupter in the form of a vacuum circuit breaker. Date is prior to Jan. 23, 2011.

International Search Report prepared by the European Patent Office as International Searching Authority in corresponding application PCT/US2013/022649 mailed May 6, 2013.

* cited by examiner

SWITCHGEAR VISIBLE DISCONNECT MECHANICAL INTERLOCK

CROSS-REFERENCE TO RELATED APPLICATION

This is a companion to concurrently filed U.S. patent application Ser. No. 13/355,906, filed Jan. 23, 2012, titled "Circuit Breaker Remote Tripping," the entire disclosure of which is hereby expressly incorporated by reference.

BACKGROUND OF THE INVENTION

The invention relates generally to electrical switchgear and, more particularly, to switchgear which combines a visible disconnect switch (typically but not necessarily manually-operated) and a circuit breaker (which may also be termed an interrupter) capable of interrupting fault currents.

SUMMARY OF THE INVENTION

In one aspect, electrical switchgear is provided. The switchgear includes a circuit breaker module in turn includes circuit breaker contacts which are opened and closed by an electrically-activated magnetic actuator, the magnetic actuator being stable in either a breaker-closed state or a breaker-open state without requiring electrical current flow through the magnetic actuator, and an externally-connectable mechanical drive linked to the magnetic actuator in a manner such that movement of the externally-connectable mechanical drive can destabilize the breaker-closed state to open the circuit breaker contacts. A visible disconnect switch is connected electrically in series with the circuit breaker contacts, and a main switch actuator is linked so as to open and close the visible disconnect switch when moved in one direction or another between a switch-open position and a switch-closed position. The switchgear also includes a mechanical interlock mechanism driven by the main switch actuator and connected so as to force movement of the externally-connectable mechanical drive so as to cause the circuit breaker contacts to open as the main switch actuator begins to move from its switch-closed position to its switch-open position.

In another aspect, electrical switchgear is provided. The switchgear includes a circuit breaker module in turn including circuit breaker contacts which are opened and closed by an electrically-activated magnetic actuator, the magnetic actuator being stable in either a breaker-closed state or a breaker-open state without requiring electrical current flow through the magnetic actuator, and a synchronizing shaft linked to the magnetic actuator in a manner such that external rotation of the synchronizing shaft can destabilize the breaker-closed state to open the circuit breaker contacts. A visible disconnect switch is connected electrically in series with the circuit breaker contacts, and a main actuator shaft is linked so as to open and close the visible disconnect switch when rotated in one direction or another between a switch-open position and a switch-closed position. The switchgear also includes a trip lever assembly including a bearing-supported hub freely rotatable on a bearing, and a trip lever extending radially from the bearing-supported hub. A linkage transfers rotation of the bearing-supported hub to rotation of the synchronizing shaft, and vice versa. A tripping assembly driven by the main actuator shaft includes a trip lever actuator positioned so as to engage the trip lever to rotate the bearing-supported hub and thus rotate the synchronizing shaft to cause the circuit breaker contacts to open as the main actuator shaft begins to rotate from its switch-closed position to its switch-open position.

DETAILED DESCRIPTION

Figure 1A:
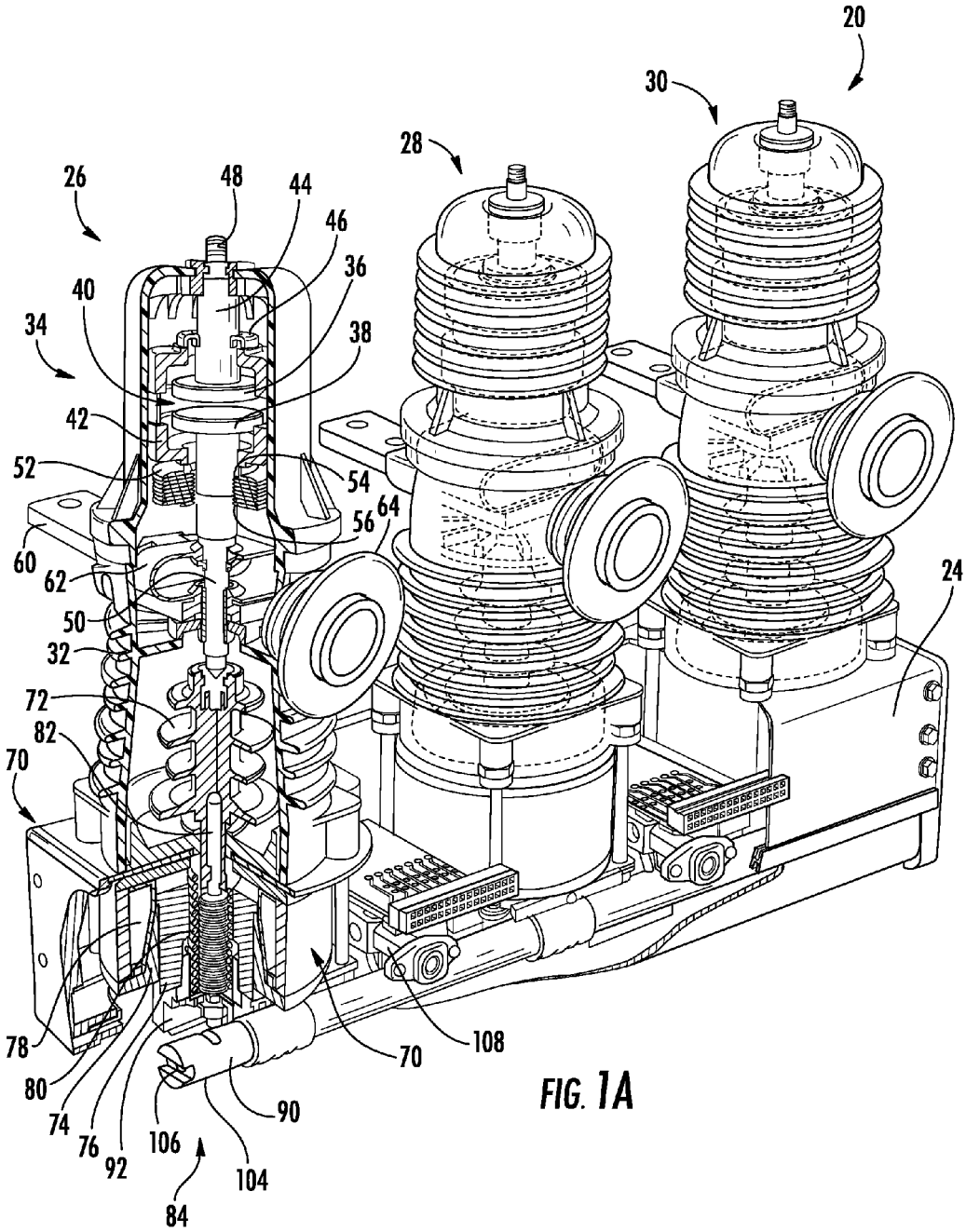
FIG. 1A is a three-dimensional view of an "LD Series" circuit breaker manufactured by Tavrida Electric.

FIGS. 1A, 1B, 1C and 1D illustrate a circuit breaker module 20 having particular characteristics, described hereinbelow, which are utilized in embodiments of the subject invention. (Depending on the context, a circuit breaker may also be termed an interrupter. For purposes of this disclosure, the two terms have the same meaning.)

By way of example and not limitation, the particular circuit breaker module 20 illustrated in FIGS. 1A-1D is an "LD Series" circuit breaker module manufactured by Tavrida Electric, and available through their North American office located on Annacis Island, Delta, British Columbia, Canada, internet website tavrida-na.com. "LD Series" circuit breaker modules are available in 5 kV, 15 kV, and 27 kV sizes. The circuit breaker module 20 is similar to, and employs the same principles as a circuit breaker module disclosed in international patent application Publication No. WO 2004/086437

A1, titled "Vacuum Circuit Breaker," and naming as applicant Tavrida Electrical Industrial Group, Moscow, Russia, the entire disclosure of which is hereby expressly incorporated by reference. A typical installation includes a control module 22 (represented in FIGS. 11 and 12) which generates current pulses to provide close and open (trip) functionality. However, a characteristic of the circuit breaker module 20 is that it is stable in either a breaker-closed state or a breaker-open state without requiring continuous electrical energization, such as from the control module 22. (An example of a control module is a Tavrida Electric model CM-15-1 electronic control module.)

The circuit breaker module 20 includes a base 24 which serves as a lower housing or enclosure for various components, and three individual phase modules 26, 28 and 30 partially secured within and extending upwardly from the base 24. Although a three-phase circuit breaker module 20 is illustrated, and embodiments of the invention illustrated and described herein employ a three-phase circuit breaker module, such is by way of example and not limitation. The invention may, for example, be embodied in single-phase switchgear employing a single-phase circuit breaker.

The three phase modules 26, 28 and 30 are essentially identical. Accordingly, only phase module 26 is described in detail hereinbelow, as representative.

The phase module 26 includes an outer insulating tower 32, and a vacuum circuit breaker, generally designated 34, within an upper portion of the insulating tower 32. The vacuum circuit breaker 34 more particularly includes a fixed upper circuit breaker contact 36 and a movable lower circuit breaker contact 38 which open and close during operation. In the configuration of FIG. 1A, the circuit breaker contacts 36 and 38 are open, separated by a gap of approximately three-eighths inch (1 cm). The circuit breaker contacts 36 and 38 are within a vacuum chamber 40 defined in part by a generally cylindrical ceramic body 42.

The fixed upper circuit breaker contact 36 is electrically connected to an upper terminal structure 44 which passes through a seal 46 at the top of the vacuum chamber 40, terminating in an upper screw terminal 48 at the top of the outer insulating tower 32.

The movable lower circuit breaker contact 38 is mechanically and electrically connected to a conductive rod 50 which exits the bottom of the vacuum chamber 40, sealed by a bellows-like flexible diaphragm 52 so that the conductive rod 50 can translate up and down. The diaphragm 52 is annularly sealed at its upper end 54 to the ceramic body 42 of the vacuum chamber 40, and annularly sealed at its lower end 56 to the conductive rod 50. Accordingly, the conductive rod 50 and thus the movable lower circuit breaker contact 38 can move up and down to close and open the circuit breaker contacts 36 and 38, while maintaining vacuum within the vacuum chamber 40.

The conductive rod 50 is electrically connected to a side terminal 60 of the phase module 26 via a flexible junction shunt 62. Thus, the upper screw terminal 48 and the side terminal 60 serve as external high voltage terminals of the phase module 26.

Figure 1B:
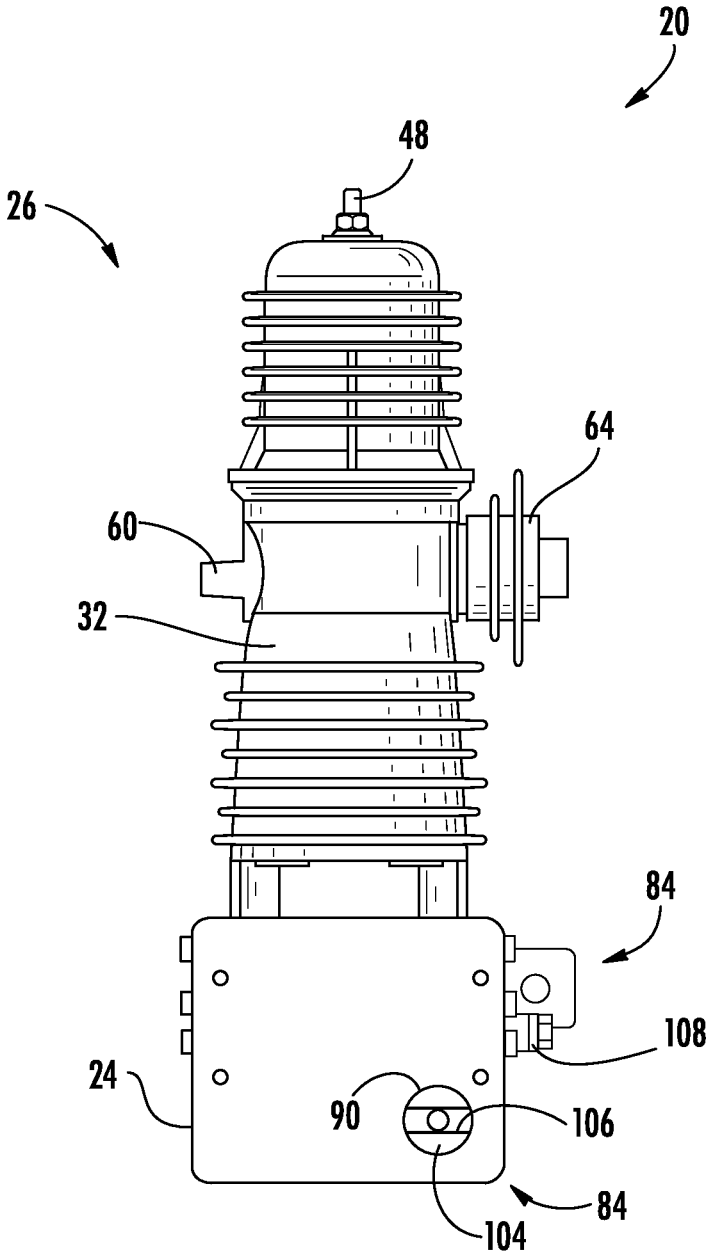
FIG. 1B is an end elevational view of the circuit breaker of FIG. 1A.
Figure 1C:
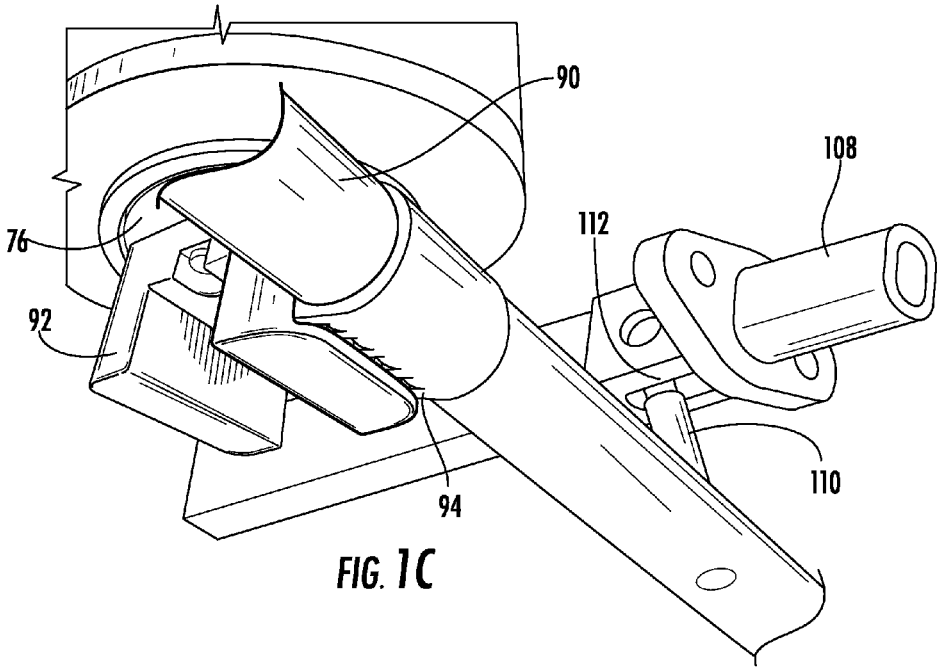
FIG. 1C is a three-dimensional underside view of a portion of the circuit breaker of FIG. 1A.
Figure 1D:
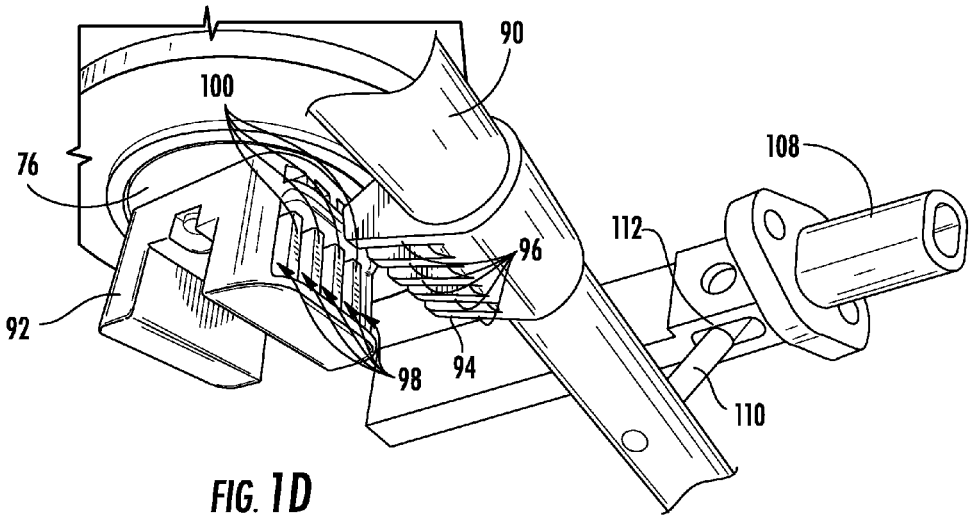
FIG. 1D is a partially exploded three-dimensional view corresponding to the view of FIG. 1C.

Also visible in FIGS. 1A and 1B is a general purpose insulated mount 64 secured to the outside of the outer insulating tower 32, and electrically insulated from the internal high voltage components. As an example, the insulated mount 64 may be employed to mechanically secure conventional barriers (not shown) between the phase modules 26 and 28, and between the phase modules 28 and 30.

Generally within the base 24, the circuit breaker module 20 includes an electrically-activated magnetic actuator 70 connected via a drive insulator 72 to drive the conductive rod 50 for closing and opening the circuit breaker contacts 36 and 38.

As described in greater detail hereinbelow, the magnetic actuator 70 is stable, without requiring electric current flow through the magnetic actuator 70, either in a breaker-closed state (in which the conductive rod 50 and movable lower circuit breaker contact 38 are driven upward), or in a breaker-open state (the configuration of FIG. 1A) in which the conductive rod 50 and the movable lower circuit breaker contact 38 are retracted downwardly.

The magnetic actuator 70 includes, near the upper end of the magnetic actuator 70, an annular magnetic stator 74; near the lower end of the magnetic actuator 70, a movable annular magnetic armature 76 which moves relative to the stator 74; and a coil 78 which is energized with electrical current to activate the magnetic actuator 70. The magnetic actuator 70 additionally includes a compression spring 80 mechanically connected so as to urge the armature 76 down and away from the magnetic stator 74.

An actuator rod 82 is connected to be driven by the magnetic armature 76 and passes upwardly through a central passageway in the magnetic actuator 70. At its upper end the actuator rod 82 is connected to the lower end of the drive insulator 72.

Accordingly, when an energizing current is driven through the coil 78 in a manner directing the breaker contacts 36 and 38 to close, the magnetic armature 76 moves upwardly to physically contact the magnetic stator 74, driving the actuator rod 82, drive insulator 72, conductive rod 50 and movable lower circuit breaker contact 38 upwardly. When current is driven through the coil 78 in a manner directing the circuit breaker contacts 36 and 38 to open, the magnetic armature 76, urged by the compression spring 80, moves downwardly, away from the magnetic stator 74, pulling down on the drive insulator 72, and thus the conductive rod 50 and lower circuit breaker contact 38.

An important characteristic of the magnetic actuator 70 is that a portion of the magnetic stator 74 is made of high-coercivity material. In other words, and stated more generally, during operation, at least one of the magnetic stator 74 and the magnetic armature 76 has characteristics of a permanent magnet, maintaining residual magnetism, such that, in the breaker-closed state, the stator 74 and armature 76 are magnetically held tightly together, against the force of the compression spring 80, and without requiring any ongoing energization of the coil 78 to hold or maintain the closed state. Accordingly, the armature 76 is magnetically latched to the stator 74, holding the circuit breaker contacts 36 and 38 closed.

During operation, the control module 22 drives current through the coil 78 so as to close and open the circuit breaker contacts 36 and 38. More particularly, to close the circuit breaker contacts 36 and 38, the control module 22 drives a current pulse of one polarity through the coil 78, causing the magnetic armature 76 to move upward against the stator 74, to be held by residual magnetism. When the circuit breaker contacts 36 and 38 are to open (trip), the control module 22 drives a current pulse of opposite polarity through the coil 78, which demagnetizes the stator 74 and armature 76, so that the armature 76 moves downward and away from the stator 74, urged by the compression spring 80.

Thus, fundamentally the magnetic actuator 70 and therefore the phase module 26 are electrically activated by current pulses from the control module 22 to either close or open (trip) the circuit breaker contacts 36 and 38. However, the circuit breaker contacts 36 and 38 also can be mechanically opened, without requiring a current pulse through the coil 78.

More particularly, an externally-connectable mechanical drive, generally designated 84, is provided. The externally-connectable mechanical drive 84 can destabilize the breaker-closed state to open the circuit breaker contacts 36 and 38. The residual magnetic characteristics of the stator 74 and armature 76 are such that the stator 74 and armature 76 are held tightly together so long as there is no gap in between them. With sufficient external force, the armature 76 can be pulled down away from the stator 74, breaking the magnetic latch.

In the particular embodiment described in detail herein, the externally-connectable mechanical drive 84 takes the form of a shaft 90, which in a three-phase breaker also functions as and may be termed a synchronizing shaft 90, which engages a mechanical coupling structure 92 (detailed in FIGS. 1C and 1D) secured to the underside of the movable armature 76, as part of a mechanism to convert linear up and down motion of the armature 76 to rotational motion of the synchronizing shaft 90, and vice versa. The mechanical coupling structure 92, which functions as a notched rod, cooperates with a slotted tooth 94 fixed to the shaft 90 or synchronizing shaft 90. The slotted tooth 94, which resembles a cam, has a plurality of individual tooth sections 96 which engage corresponding openings 98 in the mechanical coupling structure 92, the openings 98 being separated by ribs 100. Accordingly, external rotation of the synchronizing shaft 90 (counterclockwise in the orientation of FIGS. 1A, 1B, 1C and 1D), and thus of the slotted tooth 94, pulls the coupling structure 92 downward, and the magnetic armature 76 away from the stator 74, thereby breaking the magnetic latching effect, destabilizing the breaker-closed state, so that the circuit breaker contacts 36 and 38 open.

Conversely, during normal operation of the circuit breaker module 20, when the coil 78 is driven by the control module 22, up and down motion of the magnetic armature 76 is transmitted via the coupling structure 92 and the slotted tooth 94 to rotate the synchronizing shaft (or, more generally, to move the externally-connectable mechanical drive 84) in one direction or another between a breaker-closed and a breaker-open position as the magnetic actuator 70 opens and closes the circuit breaker contacts 36 and 38. This movement of the externally-connectable mechanical drive 84 (rotation of the synchronizing shaft 90 in the disclosed embodiment) can be employed to mechanically drive external elements, for example, for the purpose of indicating the state of the circuit breaker module 20, in other words, whether the contacts 36 and 38 are open or closed. In addition, in order to mechanically and positively prevent closure of the circuit breaker contacts 36 and 38 notwithstanding energization of the coil 78, movement of the mechanical drive 84 can externally be blocked. In the illustrated embodiment, an end 104 of the synchronizing shaft 90 has a slot 106 extending diametrically across the end 104 to facilitate positive mechanical engagement with the synchronizing shaft 90.

In the illustrated embodiment where there are three phase modules 26, 28 and 30, another one of the functions of the synchronizing shaft 90 is to ensure that the circuit breaker contacts of all three phase modules 26, 28 and 30 open and close together. For this purpose, external mechanical connections to the synchronizing shaft 90, either to drive the synchronizing shaft 90 or to be driven by the synchronizing shaft 90, are not relevant.

Alternatively, the externally-connectable mechanical drive 84 may take the form of a push pin 108 or interlocking pin 108 which is part of the circuit breaker module 20, and is linked to the synchronizing shaft 90. (Two push pins or interlocking pins are provided, but they are essentially identical, and only push pin 108 is described in detail herein.) To convert rotational motion to the synchronizing shaft 90 to linear in-and-out motion of the push pin 108, a radially-extending pin 110 is fixed to the synchronizing shaft 90, and the pin 110 engages an aperture 112 in the push pin 108. The aperture 112 is slightly elongated.

Accordingly, externally pushing in the push pin 108 causes the synchronizing shaft 90 to rotate, in turn pulling the magnetic armature 76 down away from the stator 74 to open the circuit breaker contacts 36 and 38. Conversely, during normal operation of the circuit breaker module 20, up and down motion of the armature 76 as the coil 78 is energized is converted to rotation of the synchronizing shaft 90, which drives out and in motion of the push pin 108. Although not illustrated, external mechanical connections, described in greater detail hereinbelow, may be made to the push pin 108 rather than to the end 104 of the synchronizing shaft 90.

Figure 2:
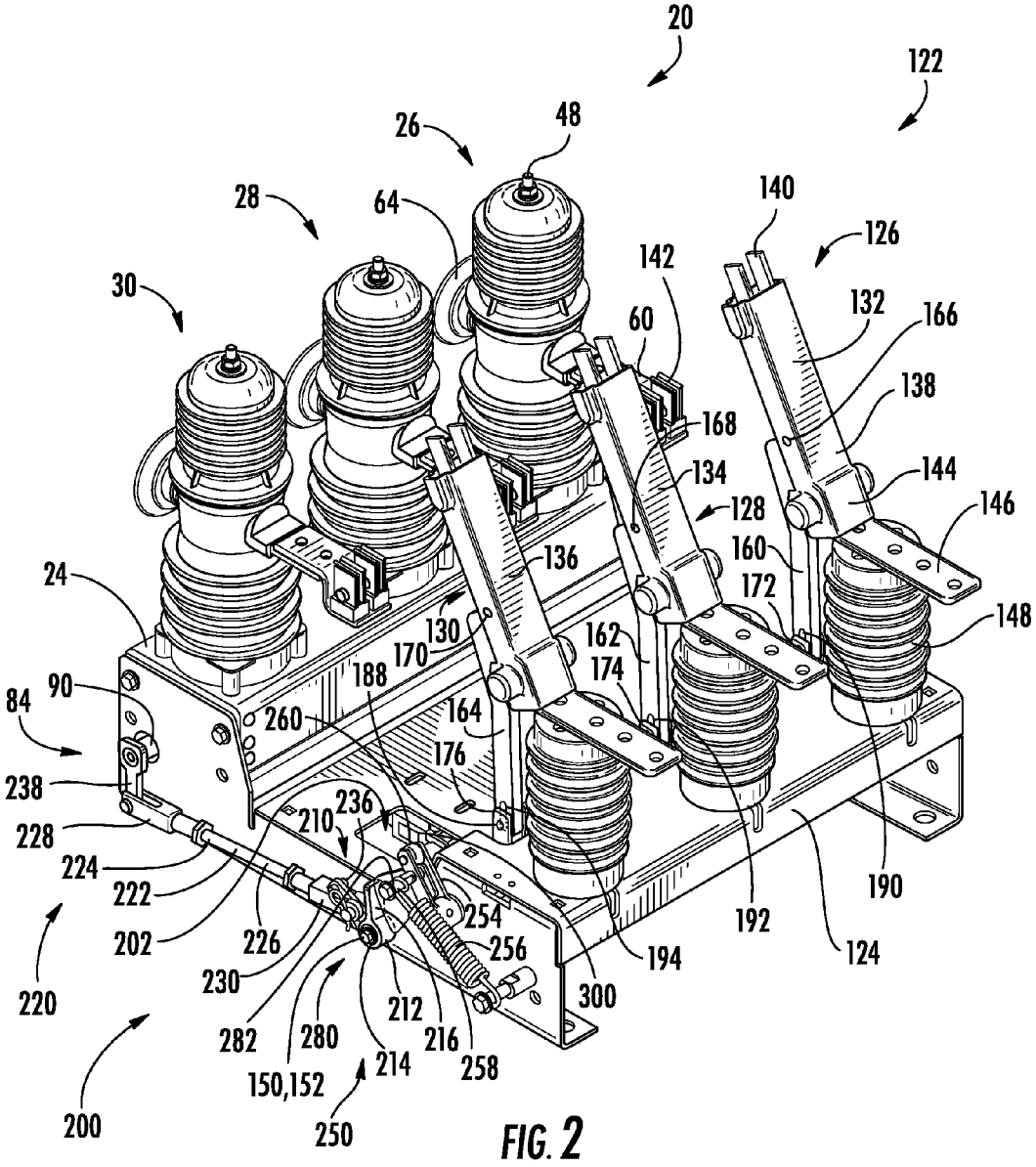
FIG. 2 is a three-dimensional view, generally from the right rear (with a linkage visible), of switchgear embodying the invention in a first configuration, wherein the disconnect switch and circuit breaker are both open.
Figure 3:
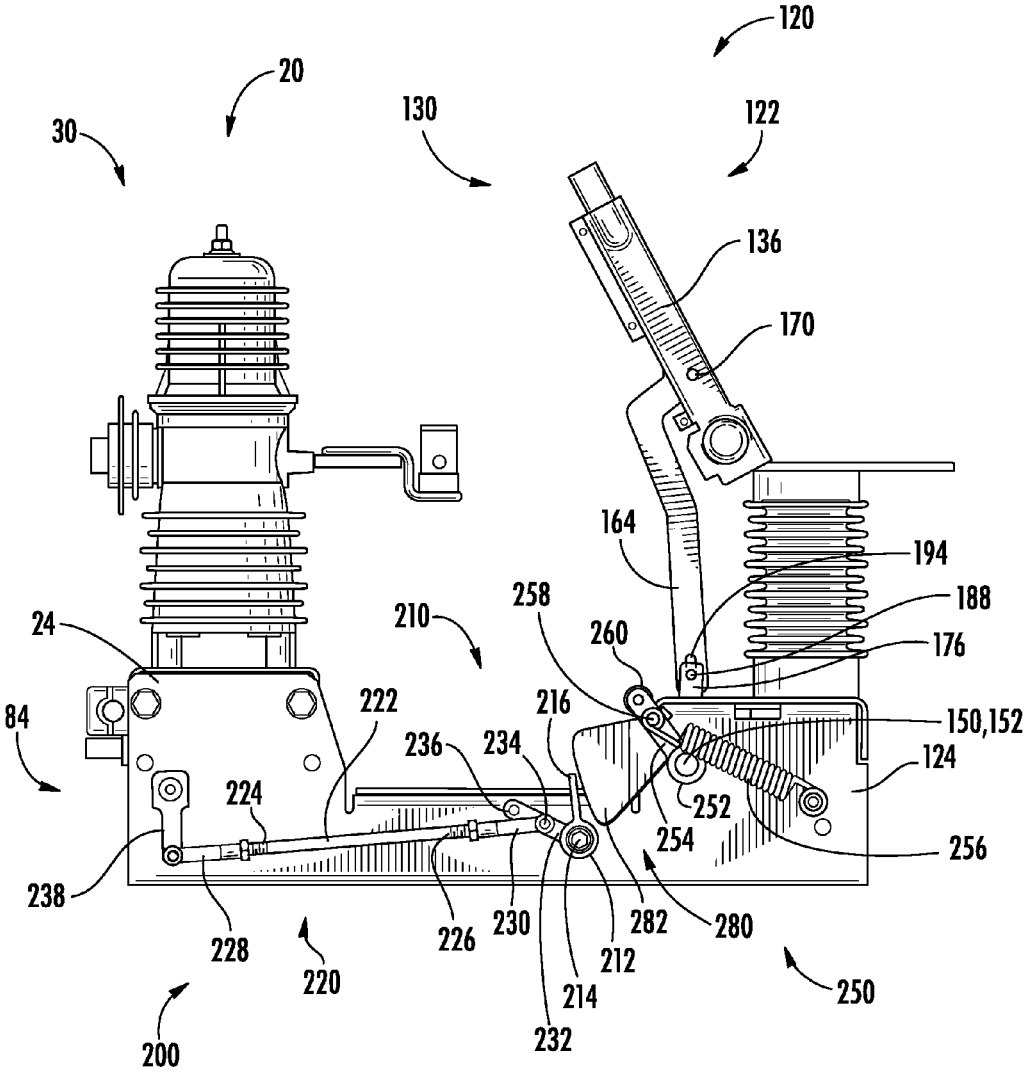
FIG. 3 is a right side (linkage side) elevational view of the switchgear in the first configuration.
Figure 4:
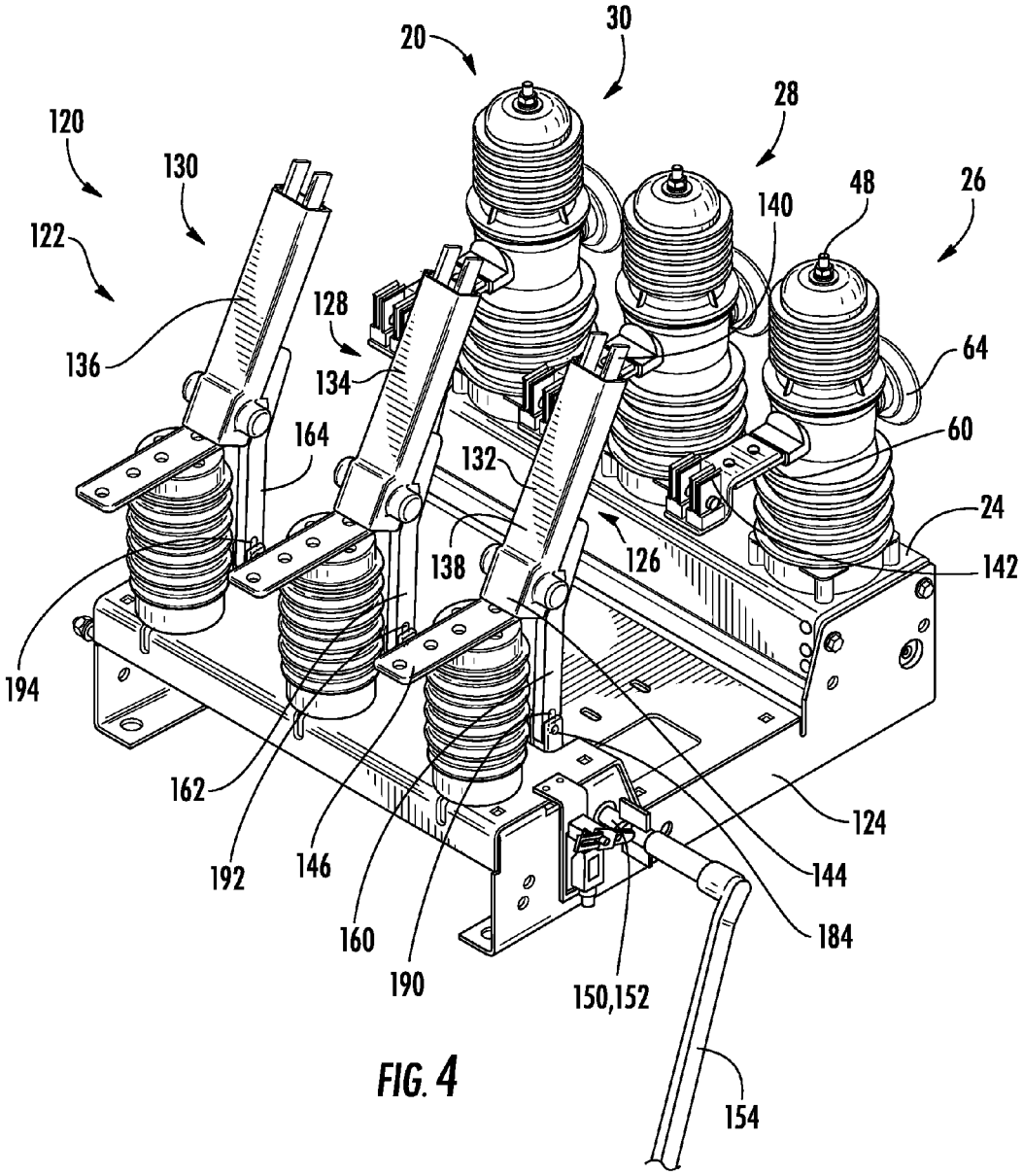
FIG. 4 is a three-dimensional view, generally from the left rear (with a manually-operable disconnect switch handle visible) of the switchgear in the first configuration.
Figure 5:
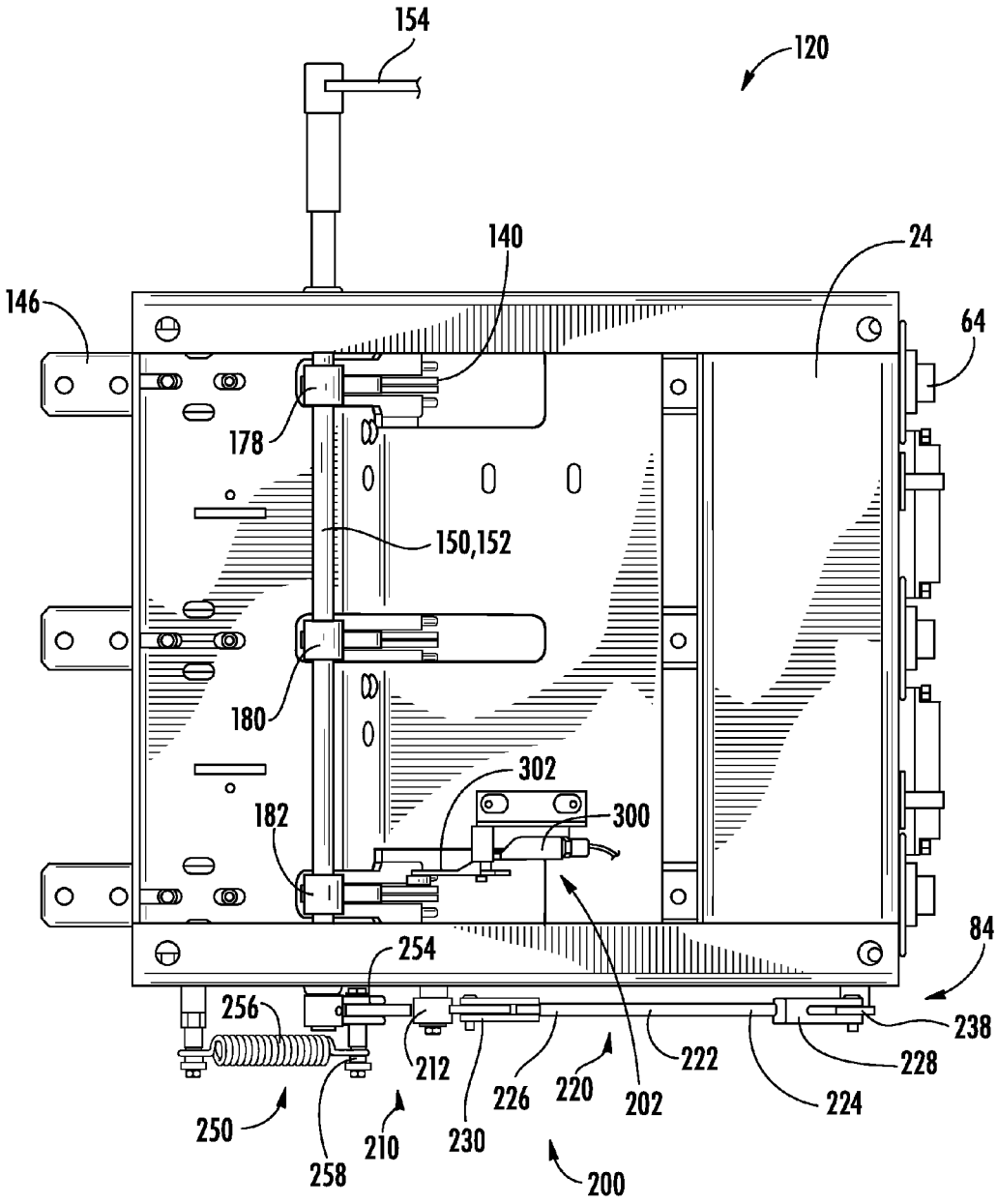
FIG. 5 is a bottom view of the switchgear in the first configuration.

Referring now to FIGS. 2-5, electrical switchgear 120 embodying the invention is shown in a first configuration. FIG. 2 is a three-dimensional view, generally from the right rear; FIG. 3 is a right side elevational view; FIG. 4 is a three-dimensional view, generally from the left rear; and FIG. 5 is a bottom view.

The electrical switchgear 120 includes the circuit breaker module 20 of FIGS. 1A-1D, as well as a visible disconnect switch, generally designated 122, connected electrically in series with the circuit breaker module 20 as described in greater detail hereinbelow. The circuit breaker module 20 and the visible disconnect switch 122 are mounted to a switchgear base 124.

The disconnect switch 122 is a three-phase switch and includes three individual switch poles 126, 128 and 130 corresponding to the individual phase modules 26, 28 and 30 of the circuit breaker module 20. Although the illustrated electrical switchgear 120 embodying the invention switches three phases, the invention may as well be embodied in single-phase switchgear.

The switch poles 126, 128 and 130 are essentially identical. Switch pole 126, connected electrically in series with phase module 26, is described hereinbelow as representative.

The disconnect switch 122 is a form of knife switch, and the representative switch pole 126 includes a lever-like knife 132. Switch poles 128 and 130 include corresponding knives 134 and 136. The representative knife 132 is hinged at one end 138, and has contacts 140 at the other end. The knife 132 contacts 140 mate with a jaw-like contact 142 mechanically secured and electrically connected to the side terminal 60 of the phase module 26. The hinge end 138 of the knife 132 is electrically and pivotally connected to a hinge and terminal structure 144 terminating in a terminal 146 of the switchgear 120. Accordingly, the terminal 146 and the upper screw terminal 48 of the phase module 26 serve as overall terminals of the switchgear 120, connected in series with a power supply line (not shown), the current through which is to be switched or interrupted. The hinge and terminal structure 144 is mounted on top of an electrical insulator 148, in turn secured to the switchgear base 124.

In the first configuration of the switchgear 120 as illustrated in FIGS. 2-5, the visible disconnect switch 122 and the circuit breaker module 20 are both open. The open state of the visible disconnect switch 122 is clearly evident from the position of the knife 132. Although internal components of the circuit breaker phase modules 26, 28 and 30 are not visible, the open state of the circuit breaker module 20 can be determined by the rotational position of the end 104 of the synchronizing shaft 90. More particularly, the rotational position of the synchronizing shaft 90 is indicated by the position of a synchronizing shaft lever arm 150 (FIGS. 2 and 3) fixedly connected to the end 105 of the synchronizing shaft, employing the slot 106 for positive location.

Figure 6:
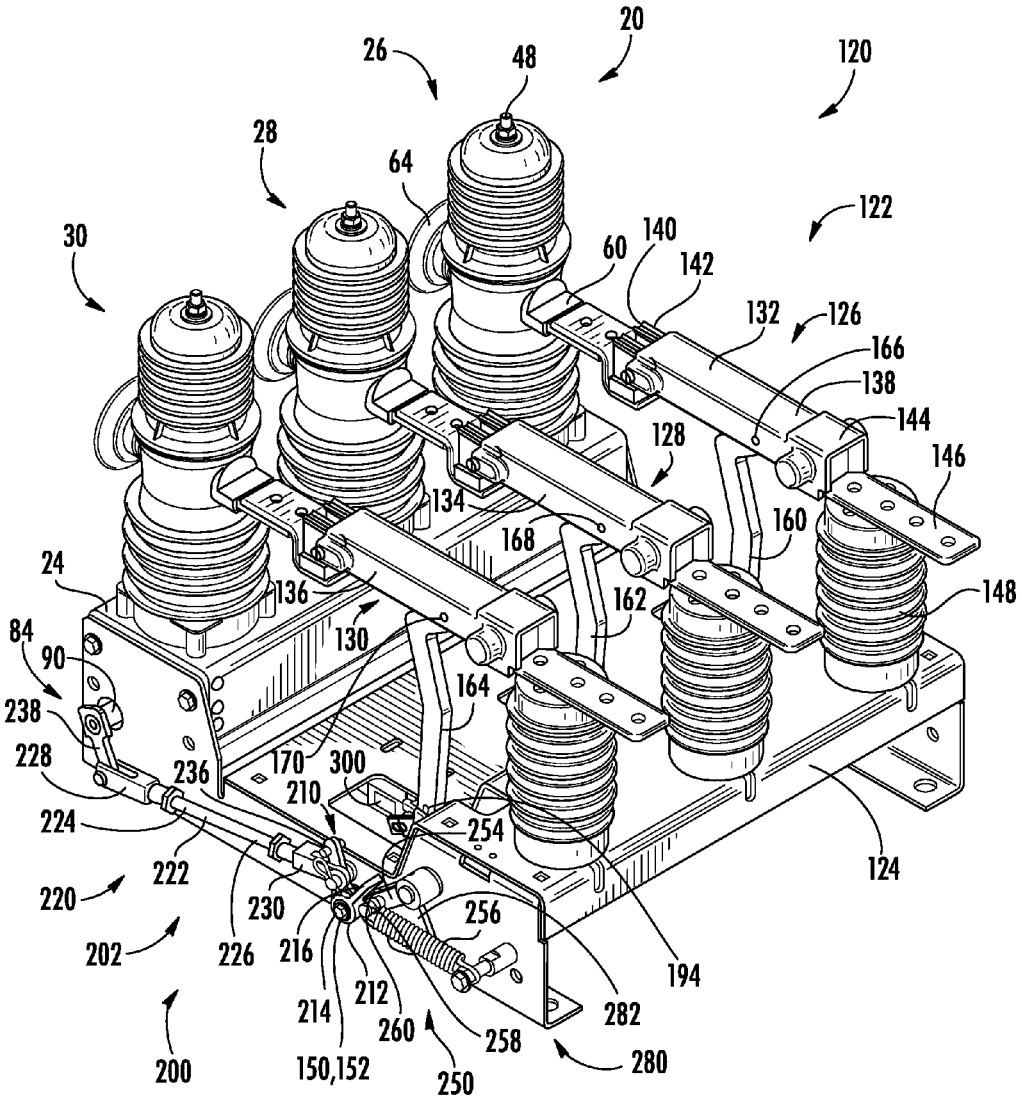
FIG. 6 is a three-dimensional view, in the same orientation as FIG. 2, generally from the right rear, of the switchgear embodying the invention, but in a second configuration, wherein the disconnect switch and circuit breaker are both closed.
Figure 7:
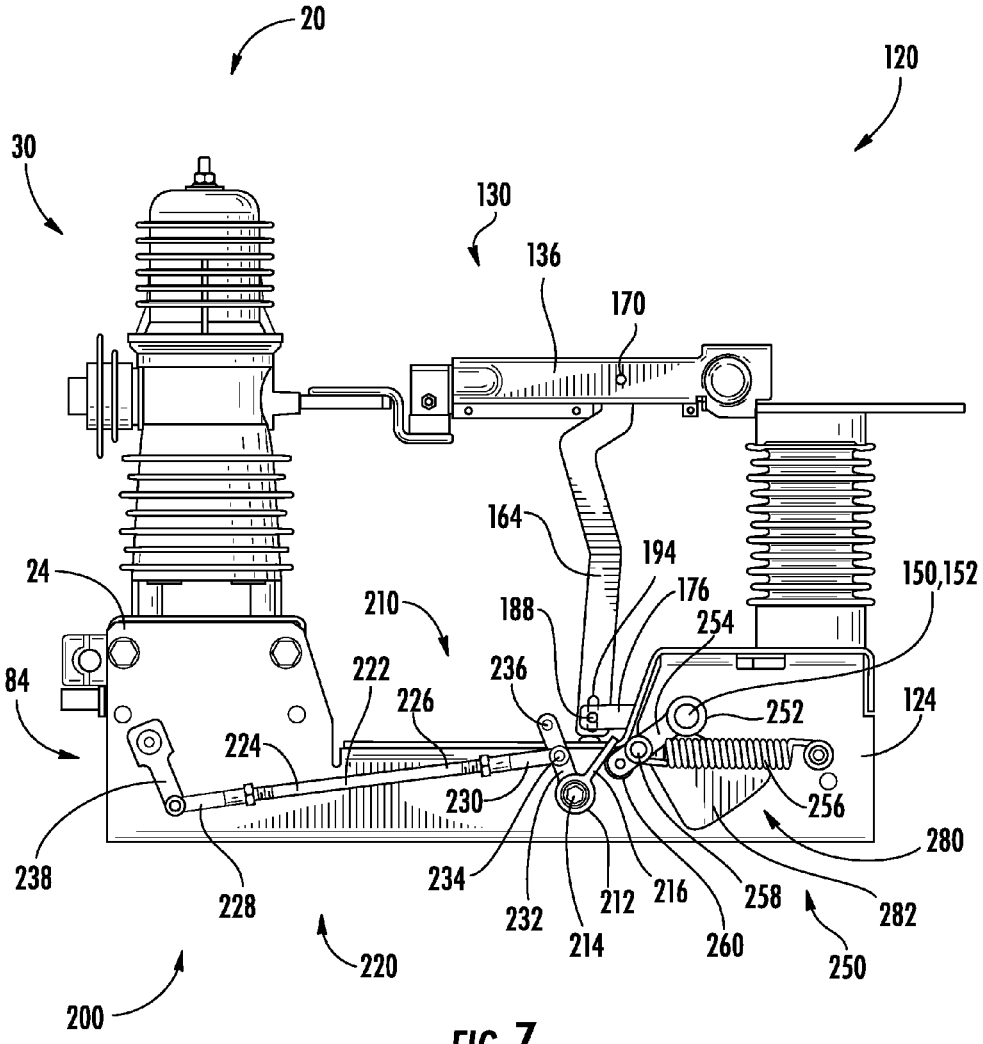
FIG. 7 is a right side (linkage side) elevational view of the switchgear in the second configuration.

FIGS. 6-9 correspondingly illustrate the switchgear 120 in a second configuration, in which both the disconnect switch 122 and the circuit breaker module 20 are closed. The closed state of the visible disconnect switch 122 is clearly evident from the position of the knife 132. Again, although internal components of the circuit breaker phase modules are not visible, the closed state of the circuit breaker module 20 can be determined by the rotational position of the synchronizing shaft, and more particularly by the position of the synchronizing shaft lever arm 150 (FIGS. 6 and 7).

Figure 10:
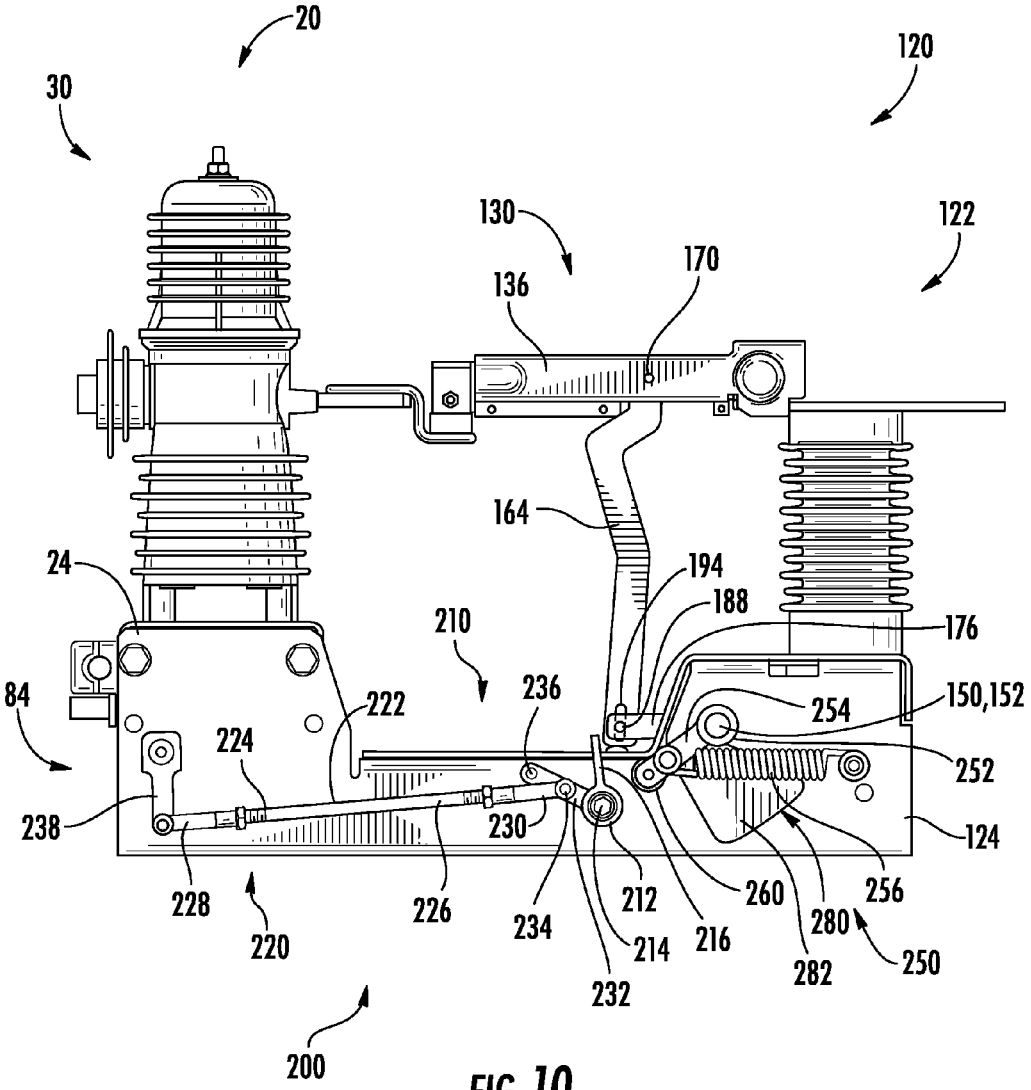
FIG. 10 is a right side (linkage side) elevational view of the switchgear, of the switchgear embodying the invention, but in a third configuration, wherein the disconnect switch is closed but the circuit breaker is open.

FIG. 10 illustrates the switchgear 120 a third configuration, in which the disconnect switch 122 is closed, but the circuit breaker module 20 is open, awaiting activation of the magnetic actuator 70. This condition is recognized by the closed state of the visible disconnect switch 122 (as in the second configuration of FIGS. 6-9), and the position of the synchronizing shaft 90 of the circuit breaker module 20 (as in the first configuration of FIGS. 1-8).

During typical operation, during which a load (not shown) is energized and de-energized through operation of the circuit breaker module, the switchgear 120 is in the second configuration of FIGS. 6-9, or the third configuration of FIG. 10. Thus, typically the visible disconnect switch 122 remains closed, while the circuit breaker module controls energization of the load.

Figure 8:
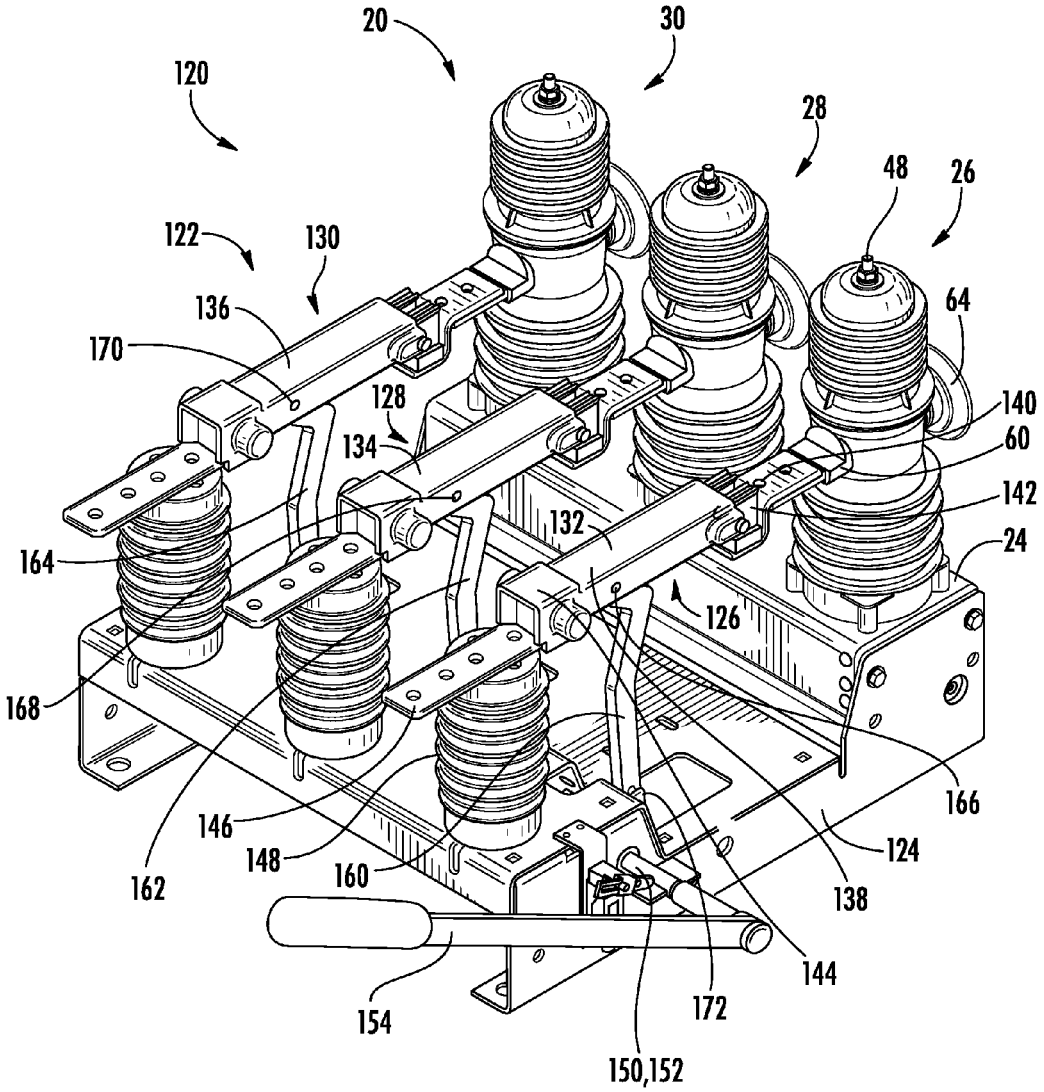
FIG. 8 is a three-dimensional view, in the same orientation as FIG. 4, generally from the left rear (manually-operable disconnect switch handle visible) of the switchgear in the second configuration.
Figure 9:
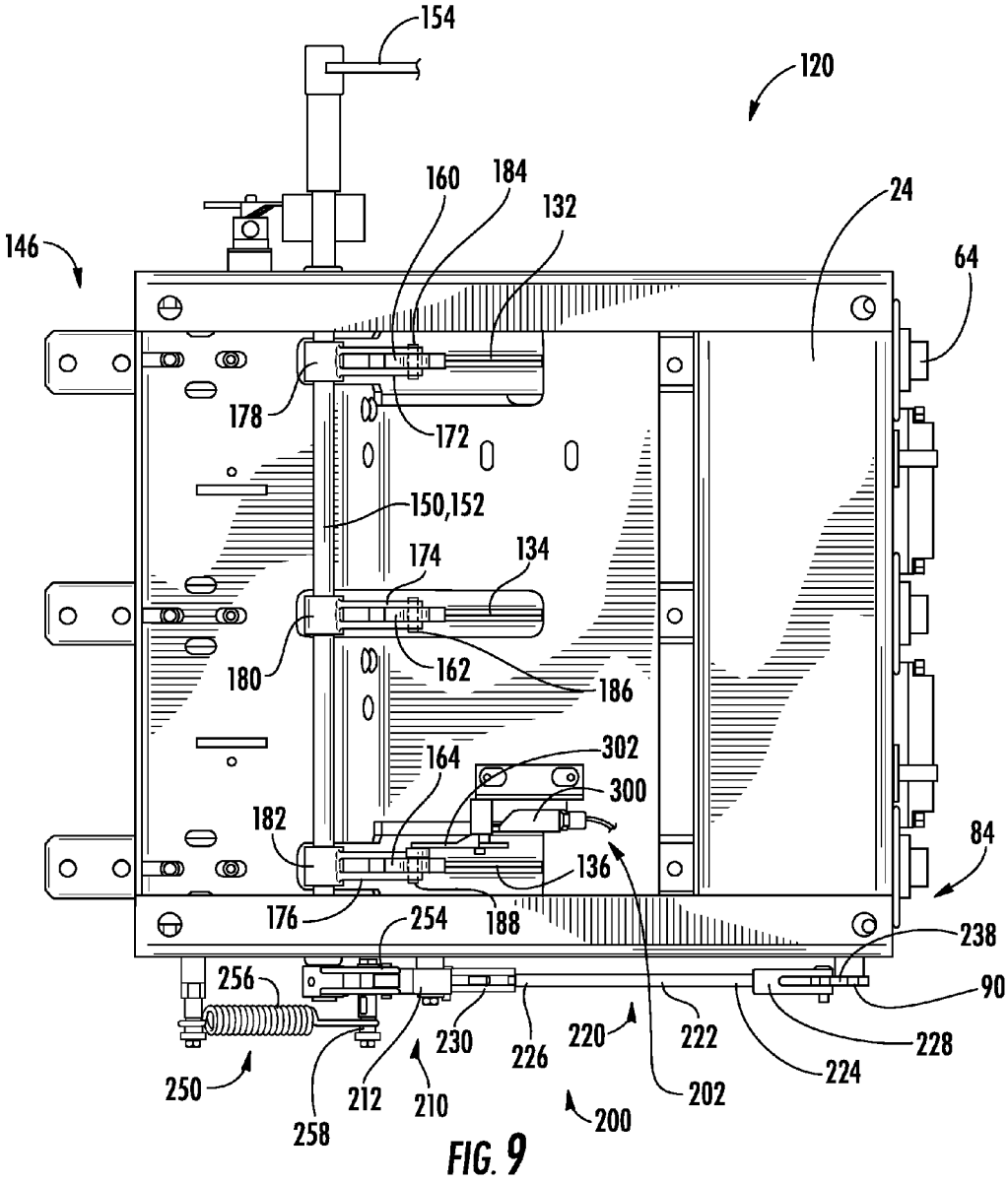
FIG. 9 is a bottom view of the switchgear in the second configuration.

For operating the visible disconnect switch 122, a main switch actuator, generally designated 150, is provided. In the illustrated embodiment, the main switch actuator 150 takes the form of a main actuator shaft 152 which is rotated through a range of approximately 90° between a switch-open position (FIGS. 2-5) and a switch-closed position (FIGS. 6-9, as well as FIG. 10.). In the illustrated embodiment, the main actuator shaft 152, and thus the visible disconnect switch 122, is manually operated by a switch handle 154 (FIGS. 4 and 8). However, it will be appreciated that the main actuator shaft 152, and more generally, the main switch actuator 150, may be moved by a motor for remote operation of the visible disconnect switch 122, while still permitting visual observation of the open or closed state of the disconnect switch 122.

The knives 132, 134 and 136 of the switch poles 126, 128 and 130 are operated by respective generally vertical push rods 160, 162 and 164. At their upper ends, the push rods 160, 162 and 164 are connected to the knives 132, 134 and 136 by simple pivots 166, 168 and 170 in the form of pivot pins 166, 168 or 170 passing through circular apertures in the corresponding knife 132, 134 or 136 and the upper end of the corresponding push rod 160 162 or 164.

At their lower ends, the push rods 160, 162 and 164 are connected to and moved by corresponding yoke arms 172, 174 and 176 welded to and extending from respective cylindrical yoke hubs 178, 180 and 182, which hubs in turn are keyed to the main actuator shaft 152. (The yoke arms 172, 174 and 176 are visible in the underside view of FIG. 9, but are hidden by the cylindrical yoke hubs 178, 180 and 182 in the underside view of FIG. 5.) In the switch-open first configuration of FIGS. 2-5, the yoke arms 172, 174 and 176 extend essentially vertically upwardly. In the second configuration of FIGS. 6-9 in which the disconnect switch 122 is closed, the yoke arms 172, 174 and 176 extend essentially horizontally.

A lost-motion connection is provided such that a predetermined degree of rotational movement of the main actuator shaft 152 occurs prior to any motion being transmitted to the push rods 160, 162 and 164 and thus to the poles 126, 128 and 130 of the visible disconnect switch 122. In particular, the ends of the yoke arms 172, 174 and 176 are pivotally connected to the lower ends of the push rods 160, 162 and 164 via respective pins 184, 186 and 188 passing through slotted apertures 190, 192 and 194 in the lower ends of the push rods 160, 162 and 164. The slotted apertures 190, 192 and 194 through which the pins 184, 186 and 188 pass provide a lost-motion link.

As thus far described, operation of the handle 154 to rotate the main actuator shaft 152 opens (FIGS. 2-5) and closes (FIGS. 6-9) the visible disconnect switch 122; and electrical activation of the magnetic actuators, such as representative magnetic actuator 70, within the circuit breaker module 20 by the control module 22 (FIG. 11) opens and closes the circuit breaker module 20.

In addition, a mechanical interlock, generally designated 200, and an electrical interlock, generally designated 202, interconnect the circuit breaker module 20 and the visible disconnect switch 122. Among other functions, the mechanical and electrical interlocks 200 and 202 ensure that switching under load, in particular current interruption, is always provided by the circuit breaker module 20 and never by the visible disconnect switch 122, which switch 122 provides visible assurance when the electrical switchgear 120 is in an open or disconnected state.

The mechanical interlock mechanism 200 is driven by the main switch actuator 150 and is connected so as to force movement of the externally-connectable mechanical drive 84 of the circuit breaker module 20 so as to cause the circuit breaker contacts, for example the contacts 36 and 38, to open as the main switch actuator 150 begins to move from its switch-closed position (FIGS. 6-9) to its switch-open position (FIGS. 2-4).

More particularly, the mechanical interlock mechanism 200 includes a trip lever assembly 210 in the form of a bearing-supported hub 212 freely rotatable on a bearing 214, and a trip lever 216 extending radially from the bearing-supported hub 212. A linkage, generally designated 220, transfers rotation of the bearing-supported hub 212 to rotation of the synchronizing shaft 90 of the circuit breaker module 20, and vice versa. The linkage 220 more particularly includes an adjustable-length connecting link 222 having first and second ends 224 and 226, and a respective clevis 228 and 230 at each end. Also fixably attached to the bearing-supported hub 212 is a connecting lever arm 232. An intermediate point 234 on the connecting lever arm 232 is pivotally connected to the clevis 230 at the second end of the connecting link 222. The connecting lever arm 232 extends past the intermediate point 234, and a pin 236 at the end of the connecting lever arm 232 functions as a stop to prevent the connecting lever arm 234 from falling through the clevis 230.

The clevis 228 at the first end 224 of the connecting link 222 is pivotally connected to a synchronizing shaft lever arm 238 fixedly connected to the end 104 of the synchronizing shaft 90, and keyed employing the slot 106.

A tripping assembly, generally designated 250, is driven by the main actuator shaft 152 and engages the trip lever assembly 210. More particularly, the tripping assembly 250 includes a cylindrical hub 252 keyed to the main actuator shaft 152, and a radially-extending yoke 254 extending from the hub 252. Bi-stable positioning is provided by a tension/extension spring 256 attached to a post on a side of the yoke 254, in an over-center arrangement. A roller 260 is supported on a bearing at the end of the yoke 254, and is positioned so as to engage the trip lever 216 so as to move the trip lever 216 up to cause counterclockwise rotation of the trip lever assembly 210 in the orientation of FIGS. 2, 3, 6 and 7, as the main actuator shaft 152 (operated by the handle 154) is moved from the switch-closed configuration of FIGS. 6-9 to the switch-open configuration of FIGS. 2-5. The linkage 220 then drives the synchronizing shaft lever arm 238 and thus the synchronizing shaft 90 of the circuit breaker module 20 to mechanically open the circuit breaker contacts. (In the third configuration of FIG. 10, the contacts of the circuit breaker module 20 are already open, so the tripping assembly 250 does not function.)

The lost motion linkage including the slotted apertures 190, 192 and 194 ensures that the trip lever 216 is tripped so that the circuit breaker 20 contacts open before there is any movement of the push rods 160, 162 and 164 to open the poles 126, 128 and 130 of the visible disconnect switch 122.

The mechanical interlock mechanism 200 additionally includes a stop, generally designated 280, mechanically connected to the main switch actuator 150 so as to be moved to a position which prevents movement of the externally-connectable mechanical drive 84 of the circuit breaker module 20 from its breaker-open position (FIGS. 2 and 3) and thus preventing closing of the circuit breaker contacts, such as the contact 36 and 38, when the main switch actuator 150 is in its switch-open position (FIGS. 2-5).

More particularly, in the illustrated embodiment the stop 280 takes the form of a cam stop 282 configured as an arcuate wing-like structure extending radially from the bearing-supported hub 212 of the trip lever assembly 210. As illustrated in FIG. 3, the cam stop 282 is immediately adjacent the trip lever 216, thus mechanically blocking movement of the bearing-supported hub 212 of the trip lever assembly 210. Accordingly, even if the magnetic actuator 70 of the circuit breaker module 20 were to attempt to close the circuit breaker contacts, such closing operation would be mechanically prevented. The stop 280 also ensures that the switchgear 120 cannot enter a forbidden state, which would be disconnect switch 122 open and circuit breaker closed.

The electrical interlock 202 more particularly includes a normally-open microswitch 300 (FIGS. 5 and 9) generally within the switchgear base 124. The microswitch 300 has an actuator arm 302 positioned so as to be actuated (thereby closing electrical contacts within the microswitch 300) by one of the three yoke arms, yoke arm 176 in the illustrated embodiment, in the closed configuration of FIGS. 6-9, wherein the yoke arm 176 is horizontal.

Figure 11:
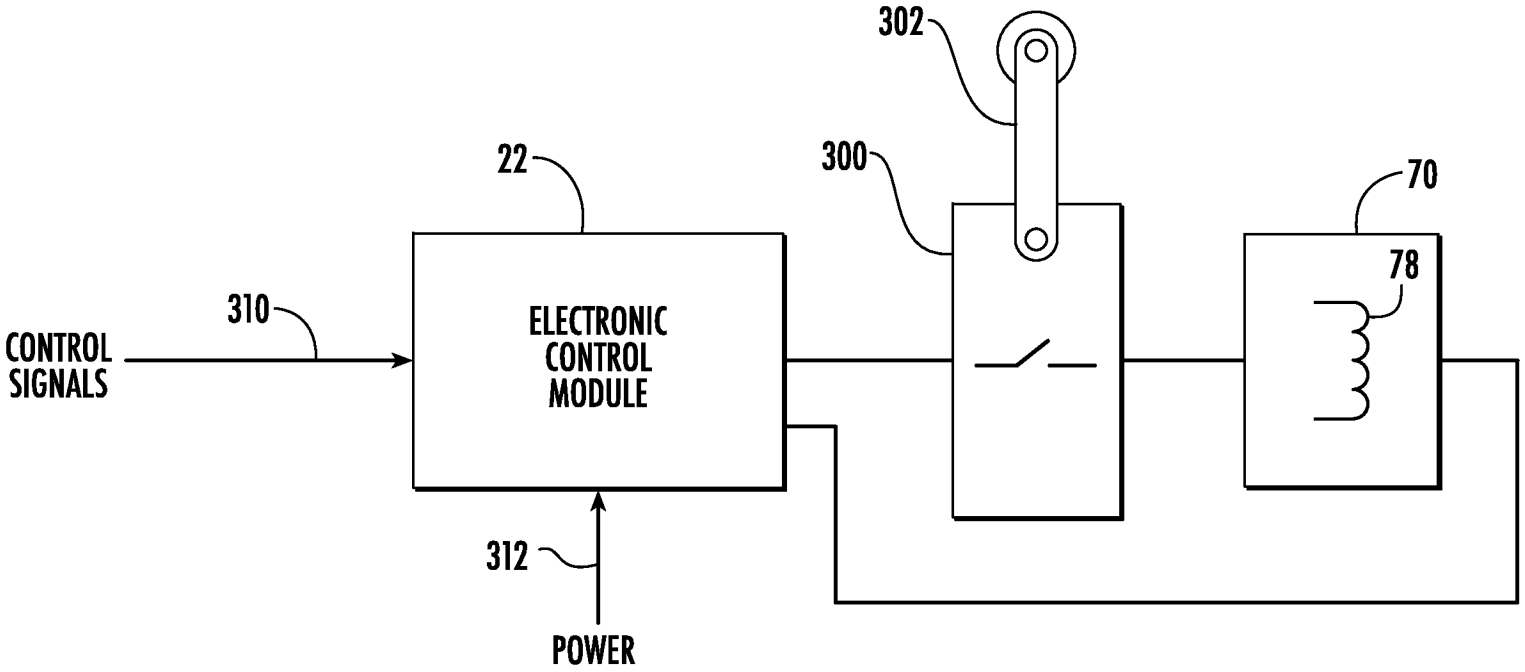
FIG. 11 is a simplified electrical schematic circuit diagram illustrating one embodiment of an electrical interlock connection.

With reference to FIG. 11, in one embodiment of the electrical interlock 202, the microswitch 300 is connected electrically in series with current drive from the control module 22 to the magnetic actuator 70 of the circuit breaker module 20, ensuring that the magnetic actuator 70 can be energized only when the visible disconnect switch 122 is closed, regardless of commands sent to the electronic control module 22 via a representative control signal line 310. As noted hereinabove, the control module 22 may be a Tavrida Electric module CM-15-1 electronic control module, as one example. Also represented in FIG. 11 is a power supply line 312 through which operating power is supplied to the electronic control module 22. Typical operating power is from a 117-volt AC power line.

Figure 12:
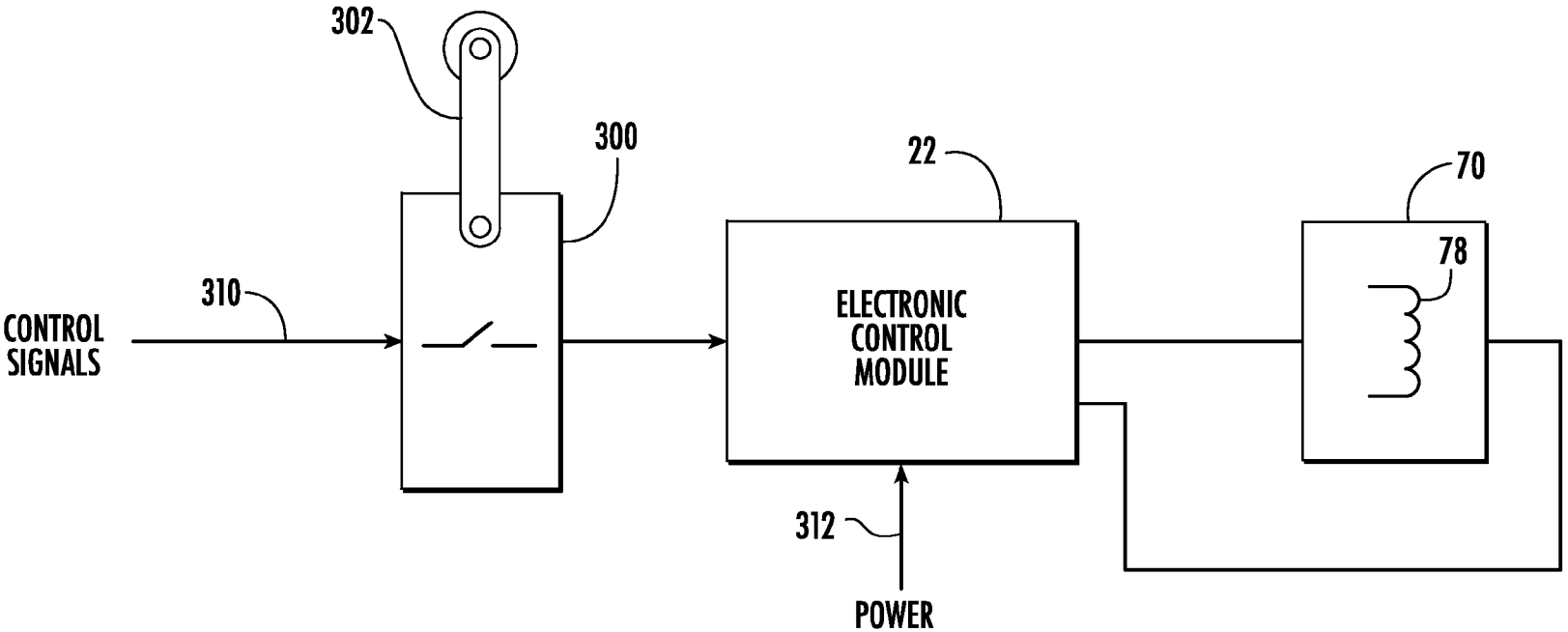
FIG. 12 is a simplified electrical schematic circuit diagram illustrating another embodiment of an electrical interlock connection.

With reference to FIG. 12, in another embodiment of the electrical interlock 202, the microswitch 300 is connected electrically in series with the representative control signal line 310 so as to prevent a command to close the contacts 36 and 38 of the circuit breaker module 20 from even reaching the control module 22 when the visible disconnect switch 122 is open.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Electrical switchgear comprising:

a circuit breaker module including circuit breaker contacts which are opened and closed by an electrically-activated magnetic actuator, said magnetic actuator being stable in either a breaker-closed state or a breaker-open state without requiring electrical current flow through said magnetic actuator, and an externally-connectable mechanical drive linked to said magnetic actuator in a manner such that movement of said externally-connectable mechanical drive can destabilize the breaker-closed state to open said circuit breaker contacts;

a visible disconnect switch connected electrically in series with said circuit breaker contacts;

a main switch actuator linked so as to open and close said visible disconnect switch when moved in one direction or another between a switch-open position and a switch-closed position; and a mechanical interlock mechanism driven by said main switch actuator and connected so as to force movement of said externally-connectable mechanical drive so as to cause said circuit breaker contacts to open as said main switch actuator begins to move from its switch-closed position to its switch-open position;

said externally-connectable mechanical drive being linked to said magnetic actuator in a manner such that said externally-connectable mechanical drive is driven to move in one direction or another between a breaker-closed and a breaker-open position as said magnetic actuator closes and opens said circuit breaker contacts; and said mechanical interlock mechanism including a stop mechanically connected to said main switch actuator so as to be moved to a position which prevents movement of said externally-connectable mechanical drive from its breaker-open position and thus preventing closing of said circuit breaker contacts when said main switch actuator is in its switch-open position.

2. The switchgear of claim 1, wherein said externally-connectable mechanical drive comprises a synchronizing shaft which rotates in one direction or another.

3. The switchgear of claim 1, wherein said main switch actuator comprises a main switch actuator shaft which rotates in one direction or another.

4. Electrical switchgear comprising:

a circuit breaker module including circuit breaker contacts which are opened and closed by an electrically-activated magnetic actuator, said magnetic actuator being stable in either a breaker-closed state or a breaker-open state without requiring electrical current flow through said magnetic actuator, and an externally-connectable mechanical drive linked to said magnetic actuator in a manner such that movement of said externally-connectable mechanical drive can destabilize the breaker-closed state to open said circuit breaker contacts;

a visible disconnect switch connected electrically in series with said circuit breaker contacts;

a main switch actuator linked so as to open and close said visible disconnect switch when moved in one direction or another between a switch-open position and a switch-closed position;

a mechanical interlock mechanism driven by said main switch actuator and connected so as to force movement of said externally-connectable mechanical drive so as to cause said circuit breaker contacts to open as said main switch actuator begins to move from its switch-closed position to its switch-open position; and an electrical interlock switch mechanically actuated by said main switch actuator and electrically connected so as to enable activation of said magnetic actuator to close said circuit breaker contacts only when said main switch actuator is in its switch closed position;

said externally-connectable mechanical drive being linked to said magnetic actuator in a manner such that said externally-connectable mechanical drive is driven to move in one direction or another between a breaker-closed and a breaker-open position as said magnetic actuator closes and opens said circuit breaker contacts; and said mechanical interlock mechanism including a stop mechanically connected to said main switch actuator so as to be moved to a position which prevents movement of said externally-connectable mechanical drive from its breaker-open position and thus preventing closing of said circuit breaker contacts when said main switch actuator is in its switch-open position.

5. Electrical switchgear comprising:

a circuit breaker module including circuit breaker contacts which are opened and closed by an electrically-activated magnetic actuator, said magnetic actuator being stable in either a breaker-closed state or a breaker-open state without requiring electrical current flow through said magnetic actuator, and a synchronizing shaft linked to said magnetic actuator in a manner such that external rotation of said synchronizing shaft can destabilize the breaker-closed state to open said circuit breaker contacts;

a visible disconnect switch connected electrically in series with said circuit breaker contacts;

a main actuator shaft linked so as to open and close said visible disconnect switch when rotated in one direction or another between a switch-open position and a switch-closed position;

a trip lever assembly including a bearing-supported hub freely rotatable on a bearing, and a trip lever extending radially from said bearing-supported hub;

a linkage to transfer rotation of said bearing-supported hub to rotation of said synchronizing shaft, and vice versa; and a tripping assembly driven by said main actuator shaft and including a trip lever actuator positioned so as to engage said trip lever to rotate said bearing-supported hub and thus rotate said synchronizing shaft to cause said circuit breaker contacts to open as said main actuator shaft begins to rotate from its switch-closed position to its switch-open position.

6. The switchgear of claim 5, which comprises three-phase switchgear and includes three circuit breaker modules; and wherein said visible disconnect switch includes three corresponding switch poles.

7. The switchgear of claim 5, wherein said linkage comprises:

a synchronizing shaft lever arm connected to said synchronizing shaft;

a connecting lever arm extending radially from said bearing-supported hub of said trip lever assembly; and a connecting link having one end connected to said synchronizing shaft lever arm and another end connected to said connecting lever arm.

8. The switchgear of claim 5, wherein said trip lever actuator comprises an actuator arm fixed to and extending radially from said main actuator shaft, and a roller at a distal end of said actuator arm.

9. The switchgear of claim 5, which further comprises an electrical interlock switch mechanically actuated by said main actuator shaft and electrically connected so as to enable activation of said magnetic actuator to close said circuit breaker contacts only when said main actuator shaft is in its switch-closed position.

10. The switchgear of claim 5, wherein:

said synchronizing shaft further is linked in a manner such that said synchronizing shaft is driven to rotate in one direction or another between a breaker-closed and a breaker-open position as said magnetic actuator closes and opens said circuit breaker contacts, and which further comprises:

a cam stop mechanically connected to said main actuator shaft so as to be rotated to a position which blocks movement of said trip lever and prevents rotation of said bearing-supported hub and thus of said synchronizing shaft from its breaker-open position and thus preventing closing of said circuit breaker contacts when said main actuator shaft is in its switch-open position.

11. The switchgear of claim 5, which further comprises a lost-motion link to ensure that said circuit breaker contacts are open prior to any motion to open said visible disconnect switch being transmitted to said visible disconnect switch.

12. The switchgear of claim 11, wherein:

said synchronizing shaft further is linked in a manner such that said synchronizing shaft is driven to rotate in one direction or another between a breaker-closed and a breaker-open position as said magnetic actuator closes and opens said circuit breaker contacts, and a cam stop mechanically connected to said main actuator shaft so as to be rotated to a position which blocks movement of said trip lever and prevents rotation of said bearing-supported hub and thus of said synchronizing shaft from its breaker-open position and thus preventing closing of said circuit breaker contacts when said main actuator shaft is in its switch-open position.

* * * * *